US008142244B2

(12) United States Patent
Fukuoka

(10) Patent No.: US 8,142,244 B2
(45) Date of Patent: Mar. 27, 2012

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 217 days.

(21) Appl. No.: 12/720,694

(22) Filed: Mar. 10, 2010

(65) Prior Publication Data

US 2010/0240267 A1 Sep. 23, 2010

(30) Foreign Application Priority Data

Mar. 19, 2009 (JP) ..... 2009-068647

(51) Int. Cl.
*B63H 20/14* (2006.01)
*B63H 23/00* (2006.01)

(52) U.S. Cl. ..... 440/75

(58) Field of Classification Search ..... 440/49, 440/53, 75–78, 88 C, 88 D, 88 G, 88 HE, 440/88 J, 88 K, 88 L, 88 M, 88 R, 89 B, 89 C, 440/89 R See application file for complete search history.

(56) References Cited

U.S. PATENT DOCUMENTS 6,146,223 A 11/2000 Karls et al.
6,634,913 B2 * 10/2003 Shibata et al. ..... 440/88 C
7,892,054 B2 * 2/2011 Fukuoka ..... 440/88 P
7,892,055 B2 * 2/2011 Fukuoka ..... 440/88 M
2008/0233815 A1 9/2008 Nakamura et al.
2009/0163092 A1 6/2009 Fukuoka

FOREIGN PATENT DOCUMENTS

JP 2686517 B2 12/1997

* cited by examiner

*Primary Examiner* — Daniel Venne
(74) *Attorney, Agent, or Firm* — Keating & Bennett, LLP

(57) ABSTRACT

An outboard motor includes a propeller, an engine, a transmission, a casing, an engine cooling mechanism, a cooling jacket, a water intake opening, and a transmission coolant flow channel. The casing is arranged to house the transmission. The engine cooling mechanism is arranged to cool the engine by supplying the water taken into the casing from the water intake opening to the engine via an engine coolant flow channel. The cooling jacket is arranged adjacent to the transmission inside the casing. The water intake opening is provided at a predetermined position of the casing to which a dynamic pressure is applied by water flow when a marine vessel travels. The transmission coolant flow channel is arranged to connect the water intake opening and the cooling jacket. The transmission coolant flow channel is provided independently of the engine coolant flow channel.

9 Claims, 4 Drawing Sheets

OUTBOARD MOTOR

BACKGROUND OF THE INVENTION

1. Field of the Invention

The present invention relates to an outboard motor arranged to generate a propulsive force to be supplied to a marine vessel.

2. Description of the Related Art

An outboard motor according to a prior art is described in US2008/0233815 A1. This outboard motor includes a propeller, an engine which rotates the propeller, a drive shaft which transmits motive power of the engine to the propeller, and a transmission interposed in the middle of the drive shaft.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

Specifically, when the engine is started, the temperature of the engine becomes high mainly due to combustion heat and frictional heat. Therefore, to prevent overheating of the engine, the engine must be cooled.

When gears and other rotary components rotate inside the transmission, the temperature of the transmission becomes high mainly due to frictional heat. In detail, lubricating oil stored inside the transmission and gears, seal ring, and other movable components provided in the transmission reach a high temperature. Therefore, to prevent degradation of the lubricating oil and thermal fatigue of the transmission and to keep the seal ring temperature in a proper range, the transmission must be cooled.

In order to overcome the previously unrecognized and unsolved challenges described above, a preferred embodiment of the present invention provides an outboard motor arranged to generate a propulsive force to be supplied to a marine vessel. The outboard motor includes a propeller, an engine, a transmission, a casing, an engine cooling mechanism, a cooling jacket, a water intake opening, and a transmission coolant flow channel. The propeller is arranged to generate the propulsive force. The engine is arranged to generate motive power to rotate the propeller. The transmission is arranged to transmit the motive power of the engine to the propeller. A casing is arranged to house the transmission. The engine cooling mechanism includes a pump arranged to take water around the casing into the casing. The engine cooling mechanism is arranged to cool the engine by supplying the water taken into the casing from the water intake opening to the engine via an engine coolant flow channel. The cooling jacket is arranged adjacent to the transmission inside the casing. The water intake opening is provided at a predetermined position of the casing to which a dynamic pressure is applied by water flow when the marine vessel travels. The transmission coolant flow channel is arranged to connect the water intake opening and the cooling jacket. The transmission coolant flow channel is provided independently of the engine coolant flow channel.

According to this arrangement, water around the casing is taken into the inside of the outboard motor by a pump and supplied to the engine via the engine coolant flow channel. Accordingly, the engine is cooled. On the other hand, for cooling the transmission, the cooling jacket is provided adjacent to the transmission inside the casing. This cooling jacket communicates with the water intake opening via the transmission coolant flow channel. The water intake opening is provided at a predetermined position of the casing to which a dynamic pressure is applied by water flow accompanying traveling of the marine vessel. Therefore, when a marine vessel including an outboard motor according to a preferred embodiment of the present invention travels, water around the casing enters the transmission coolant flow channel from the water intake opening and is delivered into the cooling jacket by a dynamic pressure. Accordingly, water around the casing is supplied as a coolant to the cooling jacket, and heat of the transmission is drawn to the coolant. Therefore, the transmission is cooled.

When the marine vessel stops, water supply by a dynamic pressure to the cooling jacket cannot be expected. However, when the marine vessel stops, heat generation inside the transmission is small, so that high-speed replacement of the coolant inside the cooling jacket is not necessary. That is, high-speed replacement of the coolant inside the cooling jacket is necessary mainly when the marine vessel travels. Therefore, according to this arrangement, a sufficient amount of coolant is supplied to the cooling jacket, when necessary, that is, when the marine vessel travels.

Also, with this arrangement, the transmission coolant flow channel is provided independently of the engine coolant channel. Therefore, water does not flow between the transmission coolant flow channel and the engine coolant flow channel. That is, with this arrangement, the mechanism for cooling the transmission (hereinafter, referred to as "transmission cooling mechanism") and the engine cooling mechanism preferably are independent of each other. The engine and the transmission are cooled by the engine cooling mechanism and the transmission cooling mechanism, respectively. Therefore, the engine and the transmission are sufficiently cooled.

For example, instead of providing the water intake opening and the transmission coolant flow channel, it is also possible that the engine coolant flow channel is branched halfway and a portion of water flowing in this flow channel is supplied to the cooling jacket. However, with this arrangement, the water supply amount to the engine is reduced, so that the engine may not be sufficiently cooled. The capacity of the pump can be increased to supply a sufficient amount of coolant to the engine, however, this increases the size of the cooling mechanism and results in increases in size and cost of the outboard motor.

By joining again water discharged from the cooling jacket after cooling the transmission with the engine coolant flow channel, a sufficient supply water amount to the engine is secured. However, in this case, water which drew heat from the transmission and was warmed is supplied to the engine, so that there is a possibility that the engine is not sufficiently cooled.

As another possible arrangement, the cooling jacket is interposed in the middle of the engine coolant flow channel. However, with this arrangement, water which drew heat from the transmission and was warmed is supplied to the engine, so that there is still a possibility that the engine is not sufficiently cooled.

On the other hand, according to a preferred embodiment of the present invention, by providing an engine cooling mechanism and a transmission cooling mechanism independent of each other, the engine and the transmission can be sufficiently cooled. Further, in a preferred embodiment of the present invention, the transmission is cooled by using a dynamic pressure accompanying traveling of the marine vessel, so that it is not necessary to provide the pump and related devices for the transmission cooling mechanism. Therefore, the arrangement of the transmission cooling mechanism is simple. Of course, a pump with a necessary and sufficient capacity for cooling the engine is provided in the engine cooling mechanism, so that increases in size and cost of the entire outboard motor do not occur.

The transmission may include a transmission case and a plurality of mechanisms housed in the transmission case. The casing may be arranged to house the transmission such that a space is formed between the casing and the transmission case. The cooling jacket may be defined by the outer wall surface of the transmission case and the inner wall surface of the casing.

According to this arrangement, the cooling jacket is defined by the outer wall surface of the transmission case and the inner wall surface of the casing. The transmission coolant flow channel is connected to a space between the transmission case and the casing, equivalent to the cooling jacket. Therefore, processing of the cooling jacket is easier than, for example, in a case in which the cooling jacket is disposed inside the outer wall of the transmission case.

The casing may include a plate arranged to be positioned above the propeller in a standard posture of the outboard motor in which the rotation axis of the propeller is horizontal. The water intake opening may be arranged near the propeller and below the plate.

When waves are generated due to the traveling of the marine vessel, the waves are pressed down from above by the plate positioned above the propeller. Therefore, in the space near the plate and below the plate, a high dynamic pressure is generated. Further, in the space near the propeller and below the propeller, a dynamic pressure is generated by water flow formed by the rotation of the propeller. Therefore, in the space near the propeller and below the propeller, a comparatively high dynamic pressure is generated. Therefore, when a marine vessel including the outboard motor according to a preferred embodiment of the present invention travels, water around the casing is reliably delivered into the cooling jacket by the dynamic pressure, and a sufficient amount of water is supplied to the cooling jacket. Accordingly, the transmission is sufficiently cooled.

Further, the water intake opening may be arranged at a position visible when the casing is viewed from the front in the standard posture of the outboard motor in which the rotation axis of the propeller is horizontal.

In the state in which the outboard motor according to a preferred embodiment of the present invention is in the standard posture, when a marine vessel including the outboard motor travels forward, a comparatively high dynamic pressure acts on the front surface of the casing. Therefore, water around the casing is reliably delivered into the cooling jacket by the dynamic pressure when the marine vessel travels forward, and a sufficient amount of water is supplied to the cooling jacket. Accordingly, the transmission is sufficiently cooled. On the other hand, when the marine vessel stops or travels reversely, the rotation speed of the engine is low, so that heat generation from the transmission is small. Therefore, by using the dynamic pressure generated according to forward traveling of the marine vessel, a necessary amount of water is supplied to the cooling jacket when necessary (when the marine vessel travels forward).

The outboard motor may further include a tilt mechanism. The tilt mechanism may be arranged to tilt the outboard motor with respect to a hull of the marine vessel such that the casing moves upward in a state in which a front surface of the casing is directed downward.

With this arrangement, the tilt mechanism is arranged to move the casing upward in the state in which the front surface of the casing is directed downward (tilting up of the outboard motor). Therefore, when the outboard motor is tilted up in the state in which water is stored in the cooling jacket, water stored in the cooling jacket is discharged from the outboard motor through the transmission coolant flow channel and the water intake opening. Accordingly, when the outboard motor is not in use, water inside the cooling jacket can be discharged, so that rusting, etc., of the outboard motor can be prevented.

Also, the water intake opening and the transmission coolant flow channel may be arranged to be positioned lower than the cooling jacket in the standard posture of the outboard motor in which the rotation axis of the propeller is horizontal. The cooling jacket may be arranged such that a portion of the cooling jacket is positioned lower than a water surface around the casing in the standard posture of the outboard motor when the speed of the marine vessel is not more than a predetermined value.

When the speed of the marine vessel is not more than the predetermined value, the dynamic pressure acting on the casing is smaller than in the case in which the speed of the marine vessel is more than the predetermined value. Therefore, the water amount to be supplied to the cooling jacket by the dynamic pressure is reduced. On the other hand, with this arrangement, even when the speed of the marine vessel is not more than the predetermined value, water around the casing is supplied by the water pressure (static pressure) to at least a portion of the cooling jacket through the water intake opening and the transmission coolant flow channel. Therefore, even when the speed of the marine vessel is not more than the predetermined value, the transmission is reliably cooled. When the marine vessel stops or travels at a low speed, the amount of heat generation of the transmission is small. Therefore, when the speed of the marine vessel is not more than the predetermined value, even without high-speed replacement of water inside the cooling jacket, the transmission can be kept at a sufficiently low temperature.

Also, the transmission may be arranged such that a lubricant circulates inside the transmission. The transmission may include a lubricant storage portion. The lubricant storage portion may be arranged to be positioned lower than the water surface around the casing in the standard posture of the outboard motor when the speed of the marine vessel is not more than the predetermined value.

With this arrangement, even when the speed of the marine vessel is not more than the predetermined value and the dynamic pressure acting on the casing is small, the lubricant storage portion provided in the transmission is reliably cooled. Therefore, the lubricant stored in the lubricant storage portion is reliably cooled. Therefore, even when the marine vessel stops or travels at a low speed, the cooled lubricant circulates inside the transmission and cools the entire transmission.

The cooling jacket may include a water receiving opening and a water discharge opening. The water receiving opening may be arranged to take in water supplied through the transmission coolant flow channel. The water discharge opening may be arranged to discharge water taken in the cooling jacket to the outside of the cooling jacket.

With this arrangement, water around the casing is supplied to the cooling jacket from the water receiving opening through the transmission coolant flow channel. When the water level in the cooling jacket reaches the position of the water discharge opening, water stored in the cooling jacket is discharged from the water discharge opening. Therefore, when traveling of the marine vessel is continued, while water which drew heat from the transmission and was warmed is discharged from the cooling jacket through the water discharge opening, water at a low temperature is continuously supplied to the cooling jacket through the water receiving opening. Accordingly, the transmission is efficiently cooled.

Water discharged from the cooling jacket is preferably discharged from the outboard motor without joining with water flowing in the engine coolant flow channel. Accordingly, water which drew heat from the transmission and was warmed can be prevented from being supplied to the engine. Therefore, the engine can be efficiently cooled.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
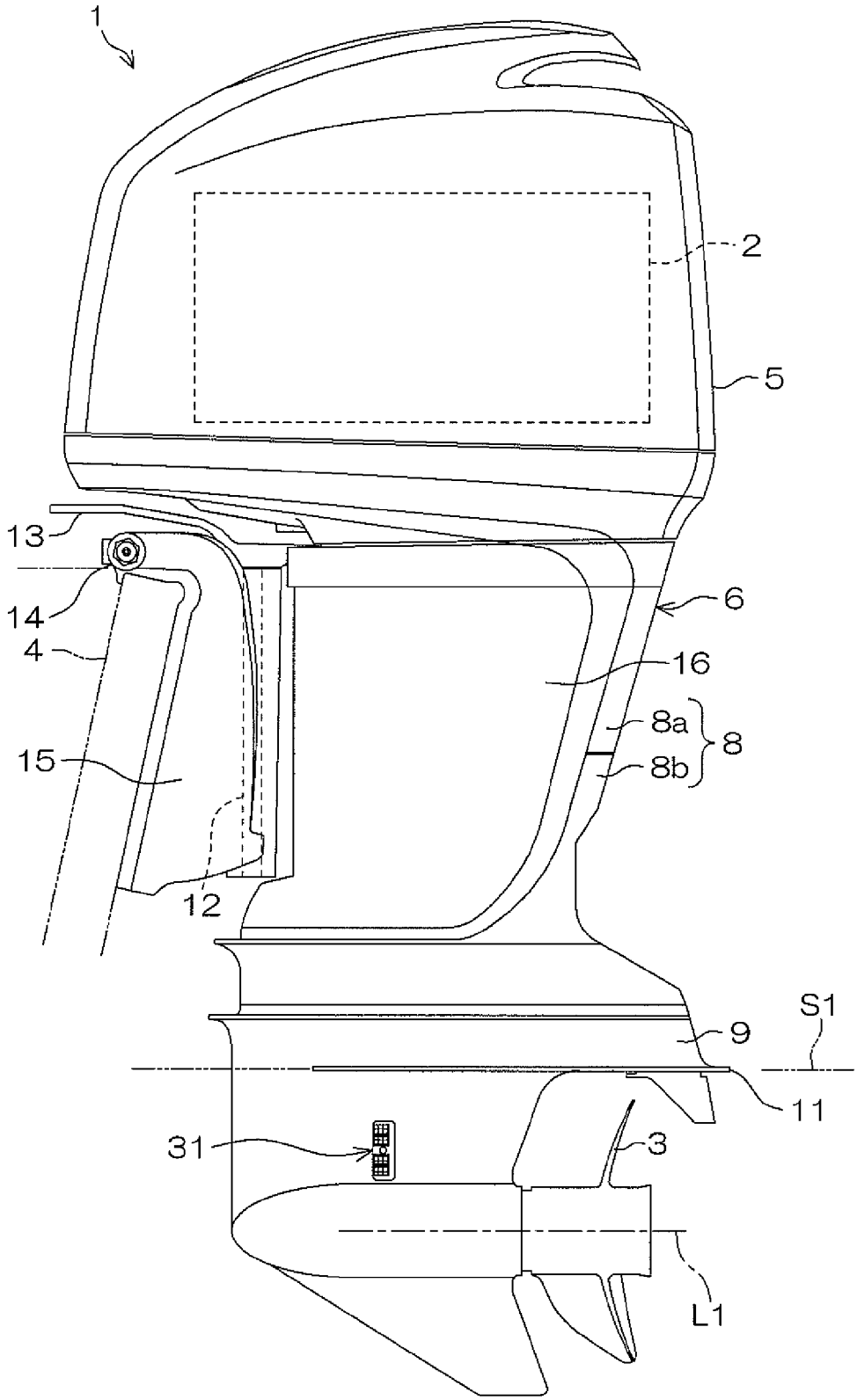
FIG. 1 is a side view of an outboard motor according to a first preferred embodiment of the present invention.

FIG. 1 is a side view of an outboard motor 1 according to a first preferred embodiment of the present invention.

The outboard motor 1 supplies a propulsive force to a marine vessel by rotating a propeller 3 by an engine 2. FIG. 1 shows a state in which the outboard motor 1 is in a standard posture. The standard posture is a posture of the outboard motor 1 in which the rotation axis L1 of the propeller 3 is horizontal. Hereinafter, description is given based on the state in which the outboard motor 1 is in the standard posture. Further, hereinafter, an attachment structure for attaching the outboard motor 1 to a hull 4, a transmission structure arranged to transmit motive power of the engine 2 to the propeller 3, and a cooling structure arranged to cool the outboard motor 1 will be described. First, the attachment structure will be described with reference to FIG. 1.

The outboard motor 1 includes the propeller 3 which generates a propulsive force, the engine 2 which generates motive power to rotate the propeller 3, an engine cover 5 housing the engine 2, and a casing 6 joined to a lower portion of the engine cover 5. The engine 2 preferably is, for example, a V-six 4-cycle engine. The engine 2 is arranged such that a crankshaft 7 (see FIG. 2) extends vertically. The casing 6 includes an upper case 8 and a lower case 9. The propeller 3 is held by the lower case 9.

A cross section of the lower case 9 has a streamline shape symmetrical in the left-right direction (direction perpendicular or substantially perpendicular to the paper surface of FIG. 1). The width of the lower case 9 in the left-right direction is maximum at a portion at which a drive shaft 10 described later (see FIG. 2) is positioned. The propeller 3 is arranged below a cavitation plate 11 provided in the lower case 9. The cavitation plate 11 is arranged in a horizontal posture at a position proximal to the propeller 3 above the propeller 3. The outboard motor 1 is attached to the hull 4 such that the cavitation plate 11 and the water surface around the casing 6 (see the phantom line S1 in FIG. 1) are at the same height during normal traveling of the marine vessel except for periods of low-speed traveling and reverse traveling.

To the upper case 8, a swivel bracket 13 is attached via a steering shaft 12. The steering shaft 12 is arranged along the vertical direction. The upper case 8 is turnable around the central axis of the steering shaft 12 with respect to the swivel bracket 13. To the swivel bracket 13, a clamp bracket 15 is attached via a tilt shaft 14. The outboard motor 1 is attached to the stern of the hull 4 by the clamp bracket 15. The tilt shaft 14 is arranged along the horizontal direction. The swivel bracket 13 is turnable around the central axis of the tilt shaft 14 with respect to the clamp bracket 15. The outboard motor 1 is tilted with respect to the hull 4 by turning the swivel bracket 13 upward with respect to the clamp bracket 15, and in a state in which the front surface of the lower case 9 (left side surface of the lower case 9 in FIG. 1) is directed downward, the lower case 9 can be moved upward (tilting up of the outboard motor 1). In the present preferred embodiment, a tilt mechanism includes the swivel bracket 13 and the tilt shaft 14.

To the left and right side surfaces of the upper case 8, covers 16 are attached. In the left and right side surfaces of the upper case 8, openings 17 (see FIG. 3) are provided. The left and right openings 17 of the upper case 8 are covered by the covers 16. In the present preferred embodiment, the upper case 8 is divided into upper and lower portions. The upper case 8 includes two divisions 8*a* and 8*b*.

Figure 2:
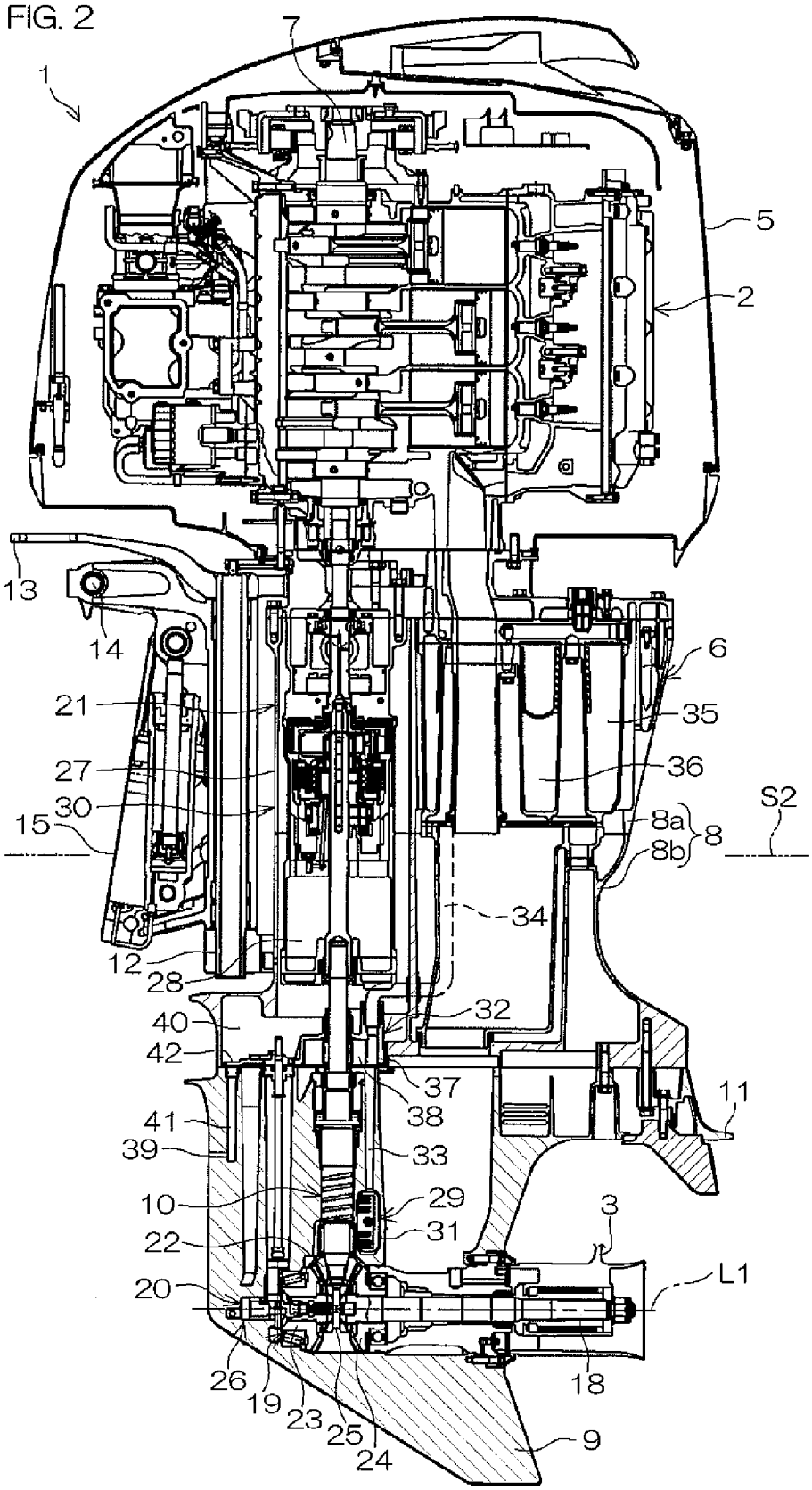
FIG. 2 is a longitudinal sectional view of the outboard motor according to the first preferred embodiment of the present invention cut along a plane along the front-rear direction.

FIG. 2 is a longitudinal sectional view of the outboard motor 1 cut along a plane along the front-rear direction of the outboard motor 1 (the left-right direction of the paper surface of FIG. 1). Hereinafter, the transmission structure for transmitting motive power of the engine 2 to the propeller 3 will be described with reference to FIG. 2.

The outboard motor 1 includes a drive shaft 10, a propeller shaft 18, a gear mechanism 19 which transmits rotation of the drive shaft 10 to the propeller shaft 18, a shift mechanism 20 which switches the rotation direction of the propeller shaft 18, and a transmission 21 joined to the middle portion of the drive shaft 10.

The drive shaft 10 is arranged along the vertical direction. The drive shaft 10 includes a plurality of shafts arranged concentrically. The drive shaft 10 is held by the casing 6 rotatably around the central axis. The upper end portion of the drive shaft 10 is positioned inside the engine cover 5. The upper end portion of the drive shaft 10 is integrally joined to the lower end portion of the crankshaft 7. Also, the lower end portion of the drive shaft 10 is positioned inside the lower casing 6. The lower end portion of the drive shaft 10 is joined to the gear mechanism 19. Rotation of the crankshaft 7 is transmitted to the gear mechanism 19 via the drive shaft 10.

The propeller shaft 18 is arranged along the horizontal direction. The propeller shaft 18 is held by the lower casing 6 rotatably around the central axis. The front end portion of the propeller shaft 18 is positioned inside the lower casing 6. The front end portion of the propeller shaft 18 is joined to the shift mechanism 20. The rear end portion of the propeller shaft 18 projects rearward from the lower casing 6. To the rear end portion of the propeller shaft 18, the propeller 3 is integrally joined.

The gear mechanism 19 includes a drive gear 22, a forward driven gear 23, and a reverse driven gear 24. The drive gear 22, the forward driven gear 23, and the reverse driven gear 24 are, for example, bevel gears. The drive gear 22, the forward driven gear 23, and the reverse driven gear 24 are preferably annularly arranged. The forward driven gear 23 and the reverse driven gear 24 engage with the drive gear 22.

The drive gear 22 is arranged such that the tooth portion is directed downward in a posture in which the rotation axis is along the vertical direction. The lower end portion of the drive shaft 10 is fitted to the inner periphery of the drive gear 22. Accordingly, the lower end portion of the drive shaft 10 is integrally joined to the drive gear 22.

Also, the forward driven gear 23 and the reverse driven gear 24 are held by the lower casing 6 rotatably around the central axis. The forward driven gear 23 and the reverse driven gear 24 are arranged in postures in which their rotation axes are along the horizontal direction. The forward driven gear 23 and the reverse driven gear 24 are arranged such that their tooth portions are opposed to each other while leaving a space therebetween in the front-rear direction. The front end portion of the propeller shaft 18 is inserted through the inner peripheries of the forward driven gear 23 and the reverse driven gear 24. The forward driven gear 23 and the reverse driven gear 24 are rotatable with respect to the front end portion of the propeller shaft 18.

The rotation of the drive shaft 10 is transmitted to the forward driven gear 23 and the reverse driven gear 24 by the drive gear 22. When the rotation of the drive shaft 10 is transmitted to the forward driven gear 23 and the reverse driven gear 24, the forward driven gear 23 and the reverse driven gear 24 rotate in directions opposite to each other.

The shift mechanism 20 includes a dog clutch 25 and a cam mechanism 26. The dog clutch 25 is arranged between the forward driven gear 23 and the reverse driven gear 24. To the inner periphery of the dog clutch 25, the front end portion of the propeller shaft 18 is spline-fitted. The dog clutch 25 is movable in the axial direction along the outer periphery of the propeller shaft 18. The dog clutch 25 is pushed by the cam mechanism 26 to move in the axial direction along the outer periphery of the propeller shaft 18. By moving the dog clutch 25 in the axial direction along the outer periphery of the propeller shaft 18, the rotation direction of the propeller shaft 18 is controlled.

In detail, the cam mechanism 26 is arranged to move the dog clutch 25 to a plurality of positions including a forward position, a reverse position, and a neutral position. At the forward position, the dog clutch 25 engages with the forward driven gear 23, and at the reverse position, the dog clutch 25 engages with the reverse driven gear 24. At the neutral position, the dog clutch 25 engages with neither the driven gear 23 nor the driven gear 24.

When the dog clutch 25 is at the forward position, the rotation of the forward driven gear 23 is transmitted to the propeller shaft 18 via the dog clutch 25. Accordingly, the propeller shaft 18 and the propeller 3 rotate integrally in a predetermined direction (forward propelling direction) to generate a propulsive force for propelling the hull 4 forward. When the dog clutch 25 is at the reverse position, the propeller shaft 18 and the propeller 3 rotate integrally in the direction (reverse propelling direction) opposite to the direction when the dog clutch 25 is at the forward position, to generate a propulsive force for propelling the hull 4 reversely. Further, when the dog clutch 25 is at the neutral position, power transmission from the drive shaft 10 to the propeller shaft 18 is cut off.

The transmission 21 includes a transmission case 27. In the transmission case 27, a plurality of mechanisms such as a gear mechanism are housed. The transmission 21 may include a planetary gear mechanism and a multiple disc clutch, may include a fluid coupling such as a torque converter, or may include a planetary gear mechanism, a multiple disc clutch, and a fluid coupling. At the lower end portion of the transmission case 27, a transmission oil pan 28 for storing a lubricant (for example, ATF (Automatic Transmission Fluid) is provided. The transmission 21 is arranged such that a lubricant circulates inside the transmission case 27.

Figure 3:
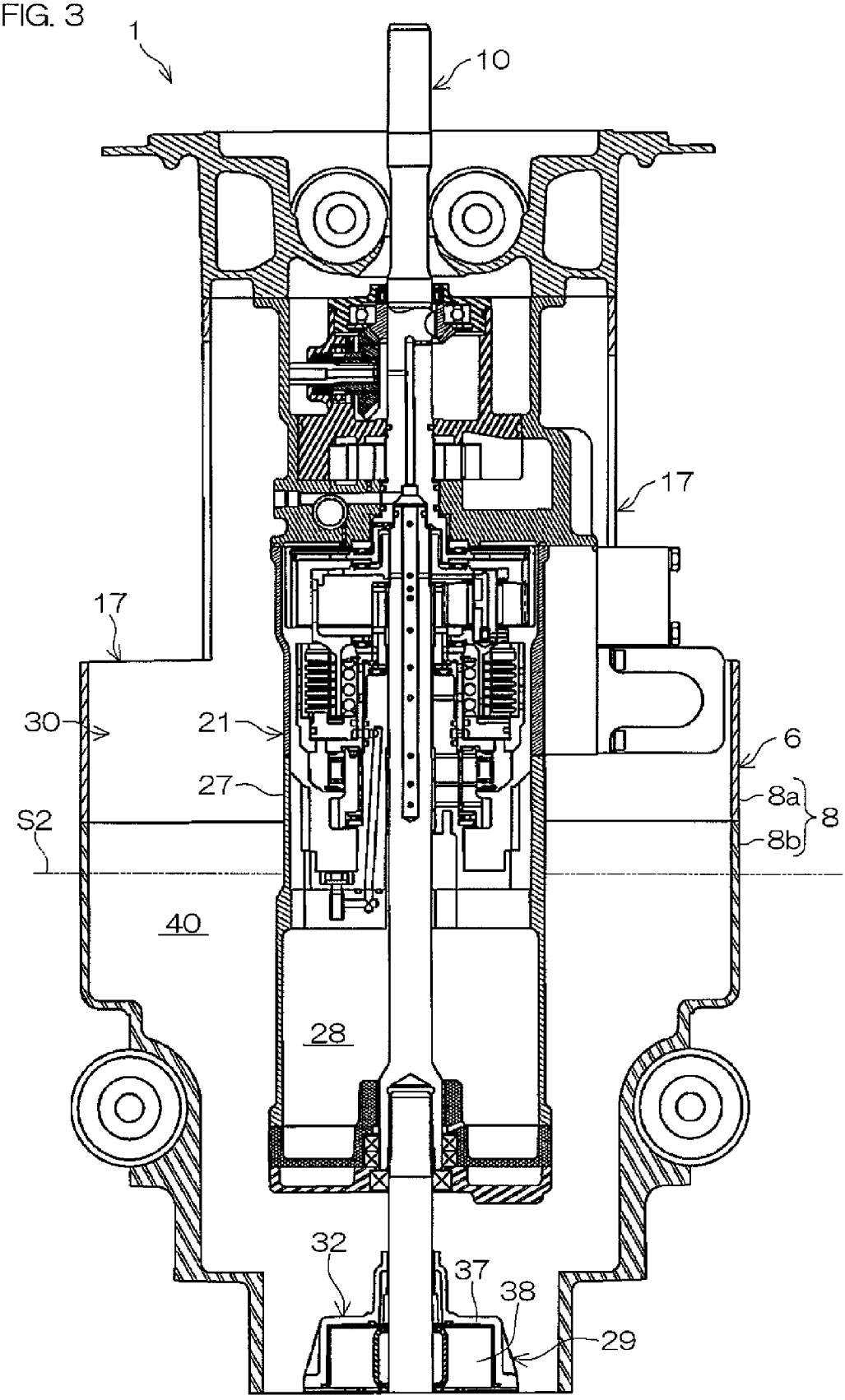
FIG. 3 is a longitudinal sectional view of an essential portion of the outboard motor according to the first preferred embodiment of the present invention cut along a plane along the left-right direction.

FIG. 3 is a longitudinal sectional view of an essential portion of the outboard motor 1 cut along a plane along the left-right direction of the outboard motor 1. Hereinafter, the cooling structure for cooling the outboard motor 1 will be described with reference to FIG. 2 and FIG. 3.

The outboard motor 1 includes an engine cooling mechanism 29 arranged to cool the engine 2, and a transmission cooling mechanism 30 arranged to cool the transmission 21. The engine cooling mechanism 29 includes an engine water intake opening 31, an engine coolant flow channel, and a water pump 32. The engine water intake opening 31 is provided on, for example, a side surface of the lower casing 6 (see FIG. 1). The engine water intake opening 31 is preferably arranged at the slight rear of the drive shaft 10 with respect to the front-rear direction of the outboard motor 1. As shown in FIG. 2, the engine water intake opening 31 is arranged to communicate with the internal space of the water pump 32 by a first flow channel 33 provided in the lower casing 6. As shown in FIG. 2, the internal space of the water pump 32 is arranged to communicate with an engine water jacket not shown by a tube 34 attached to the water pump 32 and a second flow channel 36 provided along the engine oil pan 35. In the present preferred embodiment, the path from the engine water intake opening 31 to the engine water jacket, including the first flow channel 33, the tube 34, and the second flow channel 36, defines the engine coolant flow channel. The engine water intake opening 31 is not limited to one, but a plurality of engine water intake openings may be provided.

The water pump 32 includes a cylindrical pump body 37, and an impeller 38, preferably formed of rubber, housed inside the pump body 37. The impeller 38 is fitted eccentrically to the pump body 37 inside the pump body 37. The impeller 38 is integrally joined to the middle portion of the drive shaft 10. The impeller 38 is driven to rotate by the drive shaft 10.

When the impeller 38 rotates, a negative pressure is generated inside the pump body 37. Accordingly, water around the casing 6 is taken into the first flow channel 33 from the engine water intake opening 31 and suctioned into the pump body 37 through the first flow channel 33. Water suctioned into the pump body 37 is discharged from the inside of the pump body 37 by the rotation of the impeller 38. Then, the discharged water is supplied to the engine 2 (specifically, the above-described engine water jacket) through the tube 34 and the second flow channel 36. Accordingly, water around the casing 6 is supplied as a coolant to the engine 2 and cools the engine 2. Also, water supplied to the engine 2 passes through the inside of the casing 6 again and is discharged to the outside of the casing 6.

The transmission cooling mechanism 30 includes a transmission water intake opening 39 and a water jacket 40. The transmission water intake opening 39 is provided at a predetermined position of the lower case 9 to which a dynamic pressure is applied by water flow when the marine vessel travels.

In the present preferred embodiment, as shown in FIG. 2, the transmission water intake opening 39 is arranged ahead of the drive shaft 10 and lower than the cavitation plate 11. The transmission water intake opening 39 is provided at a position visible when the casing 6 is viewed from the front. The transmission water intake opening 39 is arranged to communicate with the water jacket 40 by a third flow channel 41 provided in the lower case 9. The transmission water intake opening 39 and the third flow channel 41 are arranged lower than the water jacket 40. The transmission water intake opening 39 has an opening area, for example, smaller than the volume of the water jacket 40. The transmission water intake opening 39 is not limited to one, but a plurality of transmission water intake openings may be provided. A plurality of third flow channels 41 may be provided corresponding to the number of transmission water intake openings 39.

The water jacket 40 is provided adjacent to the transmission case 27. In detail, as shown in FIG. 3, the transmission case 27 is housed in the upper case 8. As shown in FIG. 3, between the upper case 8 and the transmission case 27, a space is provided. A portion of the space between the upper case 8 and the transmission case 27 is equivalent to the water jacket 40. Specifically, the water jacket 40 is defined by the outer wall surface of the transmission case 27 and the inner wall surface of the upper case 8. Therefore, for example, processing of the water jacket is easier than in the case in which a water jacket is disposed inside the outer wall of the transmission case 27.

Also, the water jacket 40 is adjacent to the transmission case 27 in the entire area from the lower end to the upper end of the transmission case 27. Also, the water jacket 40 is provided independently of the engine coolant flow channel, and the water jacket including the internal space of the water pump 32 is separated from the engine cooling mechanism 29. Similarly, the third flow channel 41 is separated from the engine cooling mechanism 29. Therefore, the transmission cooling mechanism 30 is separated from the engine cooling mechanism 29, and is independent of the engine cooling mechanism 29.

At least a portion of the water jacket 40 (in the present preferred embodiment, the lower end portion of the water jacket 40) is arranged so as to be positioned lower than the water surface around the casing 6 (refer to the phantom line S2 shown in FIG. 2 and FIG. 3) when the marine vessel stops or travels at a low speed (in detail, travels at a speed lower than the speed at which the marine vessel glides). The transmission oil pan 28 provided on the transmission 21 is arranged so as to be positioned lower than the water surface around the casing 6 when the marine vessel stops or travels at a low speed. Further, as shown in FIG. 2, at the lower end portion of the water jacket 40, a water receiving opening 42 for taking in water to be supplied though the third flow channel 41 is provided. The third flow channel 41 is arranged to communicate with the water jacket 40 via the water receiving opening 42. Also, as shown in FIG. 3, the upper end portion of the water jacket 40 is arranged to communicate with the space outside the casing 6 by two openings 17 provided in the left and right side surfaces of the upper case 8. In the present preferred embodiment, the openings 17 are equivalent to water discharge openings for discharging water taken into the water jacket 40 to the outside of the water jacket 40.

During normal traveling except for the periods of stoppage, low-speed traveling, and reverse traveling of the marine vessel, a high dynamic pressure is applied to the front surface and forward portions of the side surfaces of the lower case 9 by water flow accompanying traveling of the marine vessel. Therefore, water which entered the third flow channel 41 from the transmission water intake opening 39 rises up in the third flow channel 41 due to the dynamic pressure. Accordingly, water which entered the third flow channel 41 reaches the water jacket 40, and water around the casing 6 is supplied as a coolant to the water jacket 40. Thus, the transmission 21 is cooled. Then, when the water level in the water jacket 40 reaches the positions of the openings 17, water overflows from the openings 17 and water stored in the water jacket 40 is discharged to the surrounding of the casing 6 without joining with the water flowing in the engine coolant flow channel. Therefore, when normal traveling of the marine vessel including the outboard motor 1 according to the present preferred embodiment is continued, while water which drew heat from the transmission 21 and was warmed is discharged from the water jacket 40 through the openings 17, water at a low temperature is continuously supplied to the water jacket 40 through the water receiving opening 42. Accordingly, the transmission 21 is efficiently cooled. Water stored in the water jacket 40 is discharged without joining with water flowing in the engine coolant flow channel, so that warmed water is prevented from being supplied to the engine 2. Accordingly, the engine 2 is efficiently cooled.

On the other hand, when the marine vessel stops or travels at a low speed, the dynamic pressure to be applied to the front surface and forward portions of the side surfaces of the lower case 9 is small, so that the water amount to be supplied to the water jacket 40 by the dynamic pressure becomes smaller. However, the lower end portion of the water jacket 40 is arranged so as to be positioned lower than the water surface around the casing 6 when the marine vessel stops or travels at a low speed. Further, the transmission water intake opening 39 and the third flow channel 41 are arranged lower than the water jacket 40. Therefore, even when the marine vessel stops or travels at a low speed, water around the casing 6 enters the lower end portion of the water jacket 40 through the transmission water intake opening 39 and the third flow channel 41 due to the water pressure (static pressure). Therefore, even when the marine vessel stops or travels at a low speed, the lower end portion of the transmission case 27 is immersed in water. Accordingly, the transmission 21 is cooled.

As described above, the transmission oil pan 28 is arranged so as to be positioned lower than the water surface around the casing 6 when the marine vessel stops or travels at a low speed. Therefore, even when the marine vessel stops or travels at a low speed, the lubricant stored in the transmission oil pan 28 is reliably cooled. The transmission 21 is arranged such that the lubricant circulates inside the transmission case 27. Therefore, when the marine vessel stops or travels at a low speed, the cooled lubricant circulates inside the transmission case 27. Therefore, even if the transmission 21 is not entirely immersed in water, the cooled lubricant cools the entire transmission 21. Further, when the marine vessel stops or travels at a low speed, the amount of heat generation of the transmission 21 is smaller than in the case in which the marine vessel travels at a high speed, and therefore, even according to this cooling method, the transmission 21 is entirely and sufficiently cooled to a predetermined temperature. In the present preferred embodiment, an amount of water according to the speed of the marine vessel is supplied to the water jacket 40, and necessary and sufficient cooling according to the speed of the marine vessel is applied to the transmission 21.

When the marine vessel stops, the dynamic pressure being applied to the casing 6 by water flow accompanying traveling of the marine vessel extinguishes. Thus, water supply by a dynamic pressure to the water jacket 40 is stopped. Therefore, when the marine vessel stops in a state in which the water level in the water jacket 40 is high, water stored in the water jacket 40 is discharged to the surrounding of the casing 6 through the third flow channel 41 and the transmission water intake opening 39. However, in the present preferred embodiment, the opening area of the transmission water intake opening 39 and the flow channel area of the third flow channel 41 are smaller than the volume of the water jacket 40. Therefore, even when the marine vessel stops while the water level in the water jacket 40 is high, the water level in the water jacket 40 is not suddenly lowered. Therefore, almost the entire transmission 21 is directly cooled by water for a while after the marine vessel stops. Therefore, for example, even when the marine vessel traveling forward at a normal speed (except for a low speed) suddenly stops, for awhile after the marine vessel stops, almost the entire transmission 21 is sufficiently cooled. Accordingly, even when the marine vessel stops, stable cooling of the transmission 21 is continued.

As described above, in the present preferred embodiment, the engine 2 and the transmission 21 are cooled by the engine cooling mechanism 29 and the transmission cooling mechanism 30, respectively. Also, the transmission cooling mechanism 30 is independent of the engine cooling mechanism 29, so that the engine 2 and the transmission 21 can be sufficiently cooled.

For example, an arrangement may be possible in which the transmission water intake opening 39 and the third flow channel 41 are not provided, and the engine coolant flow channel is branched halfway and a portion of water flowing in this flow channel is supplied to the water jacket 40. However, in this arrangement, the amount of water to be supplied to the engine 2 is reduced, so that the engine 2 may not be sufficiently cooled. By joining water supplied to the water jacket 40 with water flowing in the engine coolant flow channel again, a sufficient amount of water to be supplied to the engine 2 can be secured. However, in this case, water which drew heat from the transmission 21 and was warmed is supplied to the engine 2, so that the engine 2 may not be sufficiently cooled.

Also, an arrangement may be possible in which the water jacket 40 is interposed in the middle of the engine coolant flow channel. However, in this arrangement, warmed water is also supplied to the engine 2, so that the engine 2 may not be sufficiently cooled.

On the other hand, in the present preferred embodiment, by providing the engine cooling mechanism 29 and the transmission cooling mechanism 30 independent of each other, the engine 2 and the transmission 21 can be sufficiently cooled. Further, in the present preferred embodiment, the transmission 21 is cooled by using a dynamic pressure accompanying traveling of the marine vessel, so that the water pump 32 and related devices are not necessary in the transmission cooling mechanism 30. Therefore, the arrangement of the transmission cooling mechanism 30 becomes simple. Further, the water pump 32 has a capacity just necessary and sufficient for cooling the engine 2. Therefore, a high-capacity pump which is large in size and high in cost is not necessary.

Second Preferred Embodiment

Figure 4:
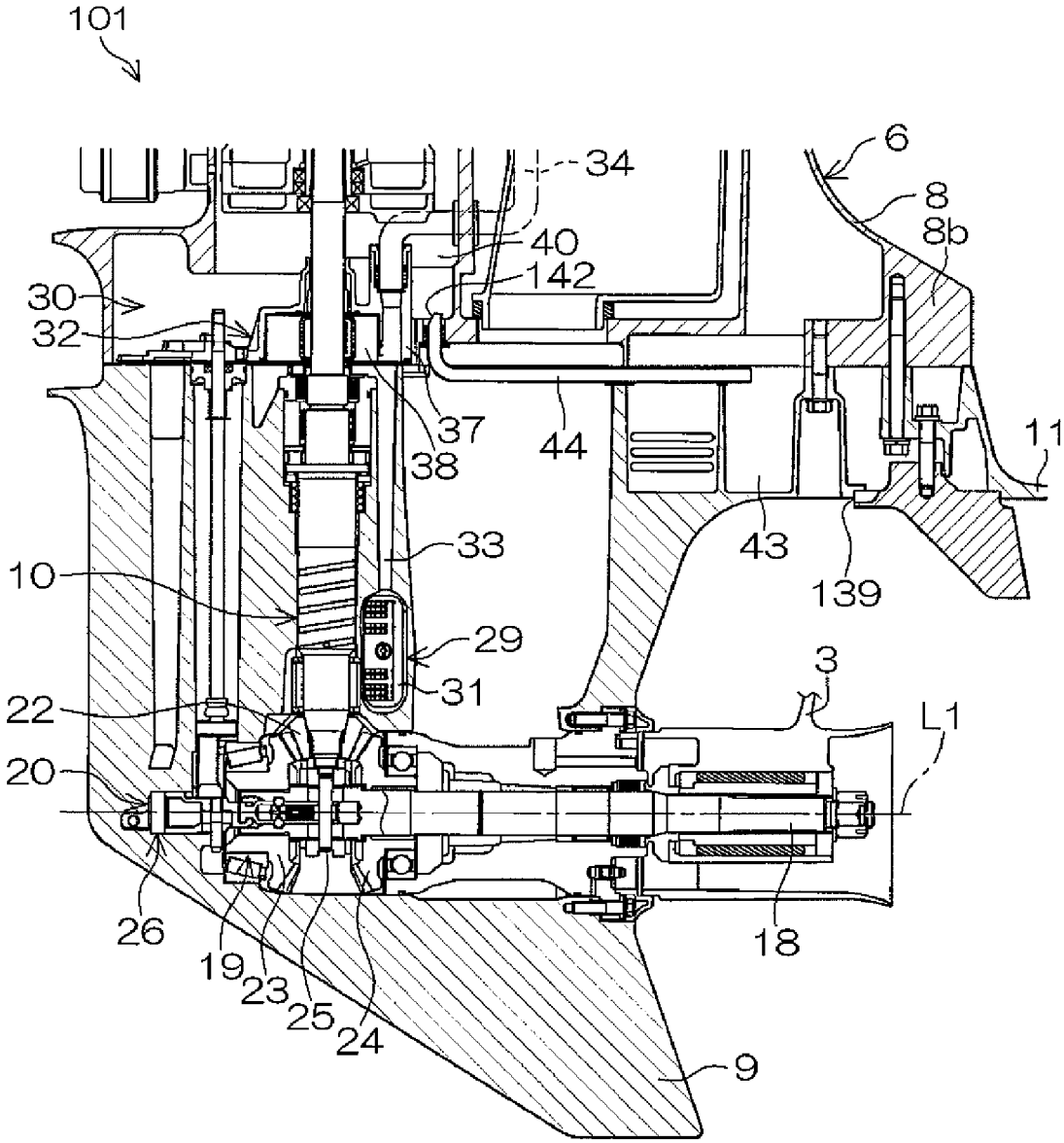
FIG. 4 is a longitudinal sectional view of an essential portion of an outboard motor according to a second preferred embodiment of the present invention.

FIG. 4 is a longitudinal sectional view of an essential portion of an outboard motor 101 according to a second preferred embodiment of the present invention. In this FIG. 4, components equivalent to those shown in FIG. 1 to FIG. 3 are designated by the same reference numerals as in FIG. 1, etc., and description thereof will be omitted.

A major difference of the second preferred embodiment from the first preferred embodiment described above is the disposition of the transmission water intake opening. In detail, in the first preferred embodiment, the transmission water intake opening 39 is preferably arranged at a position visible when the casing 6 is viewed from the front. On the other hand, in the second preferred embodiment, as shown in FIG. 4, a transmission water intake opening 139 is preferably arranged near the propeller 3 and below the cavitation plate 11. The transmission water intake opening 139 communicates with a space 43 provided inside the casing 6. To the space 43, one end of the tube 44 is connected, and to a water receiving opening 142 provided in the lower end portion of the water jacket 40, the other end of the tube 44 is connected. The transmission water intake opening 139 is arranged to communicate with the water jacket 40 by the space 43 and the tube 44. Therefore, in this second preferred embodiment, the space 43 and the tube 44 function as a transmission coolant flow channel. The space 43 and the tube 44 are provided independently of the engine coolant flow channel.

When a marine vessel including the outboard motor 101 according to the second preferred embodiment travels, waves accompanying traveling of the marine vessel are pressed down from above by the cavitation plate 11, and a dynamic pressure is generated under the cavitation plate 11. In a space below the cavitation plate 11 and near the propeller 3, a dynamic pressure is generated by water flow caused by rotation of the propeller 3. Therefore, in the space near the propeller 3 and below the cavitation plate 11, a comparatively high dynamic pressure is generated. Therefore, when the marine vessel including the outboard motor 101 travels, water around the casing 6 is reliably delivered to the water jacket 40 by the dynamic pressure, and a sufficient amount of water is supplied to the water jacket 40. Accordingly, the transmission 21 is sufficiently cooled.

Preferred embodiments of the present invention are described above, however, the present invention is not limited to the contents according to the preferred embodiments described above, and can be variously changed within the scope of claims. For example, in the first and second preferred embodiments described above, a case in which a portion of the space between the upper case 8 and the transmission case 27 is equivalent to the water jacket 40 is described. However, the arrangement of the water jacket is not limited to this. In detail, for example, it is also possible that in the transmission case 27, a space independent of a space for housing a plurality of mechanisms such as a gear mechanism is provided, and this independent space defines a cooling jacket for cooling the transmission 21.

The present application corresponds to Japanese Patent Application No. 2009-068647 filed in the Japan Patent Office on Mar. 19, 2009, the entire disclosure and contents of which are hereby incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor to generate a propulsive force to be supplied to a marine vessel, the outboard motor comprising:

a propeller to generate the propulsive force;

an engine to generate motive power to rotate the propeller;

a transmission to transmit the motive power of the engine to the propeller;

a casing to house the transmission;

an engine cooling mechanism including a pump to take water around the casing into the casing and to cool the engine by supplying the water taken into the casing to the engine via an engine coolant flow channel;

a cooling jacket located adjacent to the transmission inside the casing;

a water intake opening provided at a location on the casing to which a dynamic pressure is applied by water flow when the marine vessel travels; and a transmission coolant flow channel, provided independently of the engine coolant flow channel, to connect the water intake opening and the cooling jacket.

2. The outboard motor according to claim 1, wherein the transmission includes a transmission case and a gear mechanisms housed in the transmission case, the casing houses the transmission such that a space is provided between the casing and the transmission case, and the cooling jacket is defined by an outer wall surface of the transmission case and an inner wall surface of the casing.

3. The outboard motor according to claim 1, wherein the casing includes a plate positioned above the propeller in a standard posture of the outboard motor in which a rotation axis of the propeller is horizontal, and the water intake opening is located near the propeller and below the plate.

4. The outboard motor according to claim 1, wherein the water intake opening is located at a position that is visible when the casing is viewed from a front in a standard posture of the outboard motor in which a rotation axis of the propeller is horizontal.

5. The outboard motor according to claim 4, further comprising a tilt mechanism to tilt the outboard motor with respect to a hull of the marine vessel such that the casing moves upward in a state in which a front surface of the casing is directed downward.

6. The outboard motor according to claim 1, wherein the water intake opening and the transmission coolant flow channel are positioned lower than the cooling jacket in a standard posture of the outboard motor in which a rotation axis of the propeller is horizontal, and a portion of the cooling jacket is positioned lower than a water surface around the casing in the standard posture of the outboard motor when a speed of the marine vessel is not more than a predetermined value.

7. The outboard motor according to claim 6, wherein a lubricant circulates inside the transmission, and the transmission includes a lubricant storage portion positioned lower than the water surface around the casing in the standard posture of the outboard motor when the speed of the marine vessel is not more than the predetermined value.

8. The outboard motor according to claim 1, wherein the cooling jacket includes a water receiving opening to take in water supplied through the transmission coolant flow channel, and a water discharge opening positioned higher than the water receiving opening to discharge water taken into the cooling jacket to an outside of the cooling jacket.

9. The outboard motor according to claim 8, wherein water discharged from the cooling jacket is discharged from the outboard motor without joining with water flowing in the engine coolant flow channel.

* * * * *